United States Patent [19]

Culbertson et al.

[11] Patent Number: 5,004,403

[45] Date of Patent: Apr. 2, 1991

[54] PRESSURE RESPONSIVE DRIVERS FOR RECIPROCATING PUMP AND METHOD

[75] Inventors: Samuel W. Culbertson, Arvada; Keith G. Williams, Longmont, both of Colo.

[73] Assignee: Binks Manufacturing Company, Franklin Park, Ill.

[21] Appl. No.: 386,456

[22] Filed: Jul. 27, 1989

Related U.S. Application Data

[63] Continuation-in-part of Ser. No. 162,481, Mar. 1, 1988, abandoned.

[51] Int. Cl.[5] ..... F04B 9/06

[52] U.S. Cl. ..... 417/53; 417/214; 92/84

[58] Field of Search ..... 417/53, 214, 554, 415; 92/84

[56] References Cited

U.S. PATENT DOCUMENTS

| | | | |
|---|---|---|---|
| 3,779,669 | 12/1973 | Sommer | 417/214 |
| 4,006,797 | 2/1977 | Keske | 417/214 X |
| 4,009,971 | 3/1977 | Krohn et al. | 417/44 X |
| 4,080,108 | 3/1978 | Keske et al. | 417/214 |
| 4,527,463 | 7/1985 | Albarda | 417/214 X |

*Primary Examiner*—Leonard E. Smith
*Assistant Examiner*—Eugene L. Szczecina, Jr.
*Attorney, Agent, or Firm*—Juettner Pyle Lloyd & Verbeck

[57] ABSTRACT

A pressure responsive driver couples a reciprocating motor output to a reciprocable piston of a double-acting pump. In one embodiment, the driver comprises a single spring and in another a pair of springs, which transfer reciprocation forces of the motor output to the piston to reciprocate the piston through its pumping strokes. The spring(s) transfers the entirety of the reciprocation forces of the motor output to the piston until a selected outlet pressure from the pump is reached, whereupon the spring(s) compresses to absorb cranking forces and limit maximum pump outlet pressure to about the selected pressure. The reciprocating motion of the motor output is divided between the spring(s) and piston, such that the extent of flexure of the spring(s) is inversely proportional to movement of the piston, whereby the spring(s) takes up any motion of the motor output not used to move the piston. The driver therefore limits pump outlet pressure to about the selected pressure while allowing the motor to operate continuously.

14 Claims, 2 Drawing Sheets

PRESSURE RESPONSIVE DRIVERS FOR RECIPROCATING PUMP AND METHOD

This is a continuation-in-part of copending application Ser. No. 07/162,481 filed on Mar. 1, 1988, now abandoned.

BACKGROUND OF THE INVENTION

The present invention relates to apparatus for and methods of limiting liquid outlet pressures developed by reciprocating pumps, and in particular to pressure responsive drivers for double-acting airless pumps.

In airless spray painting, paint is supplied by a pump at high pressures on the order of about 1000 to 3000 psi to an atomizing nozzle having a small elliptically shaped orifice, and is hydraulically atomized into a fan-shaped spray upon exiting the orifice. It is conventional to spray intermittently, and a valve associated with the nozzle accommodates starting and stopping of the spray.

Some means must be provided to control internal paint pressure within the pump to prevent building up excessive pressure, particularly when the spray nozzle valve is closed. It has been proposed to use air or pneumatic motors to actuate the pump, such motors being operable only when required to meet a pressure requirement in the pump. Air motors, however, have not fulfilled all of the requirements of the art, since they require a source of air, which in the case of allegedly portable equipment requires bulky and expensive air compressors and pressure tanks.

Electric motors and gasoline engines have also been used to drive high pressure pumps for airless spraying. Most, if not all, of such units have some means for controlling the maximum liquid pressure developed by the pump, often to between 2500–3000 psi. A common type of pressure control uses a bourdon tube to sense liquid pressure and actuate a microswitch in response to the pressure reaching a selected maximum value. In the case of an electric motor driven pump, to limit pump pressure the motor may be turned on and off, often as many as 40 to 50 times per minute. On the other hand, for either electric motor or gasoline engine driven pumps, pressure control may be accomplished through an electric clutch that engages and disengages the continuously running motor or engine with and from the pump, again at approximately 40 to 50 times per minute. These pressure controls use an assortment of electronic parts such as microswitches, triacs, solid state motor starters, motor start capacitors, etc., which must be enclosed in explosion proof housings. Such electronic parts represent a principal cost component of airless pumps.

The electronic components of conventional pressure controls also are a major source of field maintenance problems. Excessive cycling of a capacitor start electric motor burns out the contacts for the starting capacitor, and because of the high surge current when the motor is started, average current draw is high and results in a shortened life of the motor, starting capacitor and start switches. Also, bourdon have a finite life and can rupture from airless pressures. Should a bourdon tube rupture, paint filling the control box not only will destroy the controls, but in the case of a clutch drive it can then flow through the control lead conduit to the clutch and destroy it. Further, the high surge current occurring at 50 to 60 times per minute pits the start switch contacts and can cause them to fuse together and keep the motor running or clutch engaged, resulting in excessive pressure at the pump outlet and rupture of the bourdon tube.

OBJECTS OF THE INVENTION

An object of the invention is to provide pressure responsive drivers for coupling a reciprocating output from a motor to a piston of a pump in a manner to limit pump outlet pressure to a selected maximum value.

Another object is to provide such pressure responsive drivers, that allow the motor to run continuously, even when the pump is not delivering fluid.

A further object is to provide such pressure responsive drivers, that enable the reciprocating motion of the motor output to be divided between the driver and pump piston, such that motion of the motor output not required to move the piston is taken up by the driver.

SUMMARY OF THE INVENTION

In accordance with the present invention, there is provided a pressure responsive driver for coupling a reciprocating output from a motor means to a reciprocable piston of a pump having a fluid inlet and a fluid outlet, wherein the pressure of fluid at the outlet is in accordance with the magnitude of reciprocation forces exerted on the piston. Said pressure responsive driver comprises reciprocable input means adapted for connection to the motor means output for reciprocation thereby, and reciprocable output means adapted for connection to the pump piston to reciprocate the piston. Said pressure responsive driver also includes means for transferring reciprocation forces exerted on said input means by the motor means output to said output means, and for limiting the magnitude of transferred forces to a predetermined maximum value while said input means continues to reciprocate. Reciprocation forces exerted on the pump piston are therefore limited to the predetermined maximum value to limit the pressure of fluid at the pump outlet to a selected value.

The invention also contemplates a method of connecting a reciprocating output from a motor to a reciprocable piston of a pump having a fluid inlet and a fluid outlet, wherein the pressure of fluid at the pump outlet is in accordance with the magnitude of reciprocation forces exerted on the piston. The method comprises the steps of mechanically coupling the reciprocating output from the motor to the pump piston to transfer reciprocation forces from the motor output to the piston; and controlling said mechanically coupling step to limit reciprocation forces transferred to the pump piston to a predetermined magnitude while the motor output continues to reciprocate, so that fluid pressure at the pump outlet is limited to a selected pressure.

The foregoing and other objects, advantages and features of the invention will become apparent upon a consideration of the following detailed description, when taken in conjunction with the accompanying drawings.

DETAILED DESCRIPTION

Figure 1:
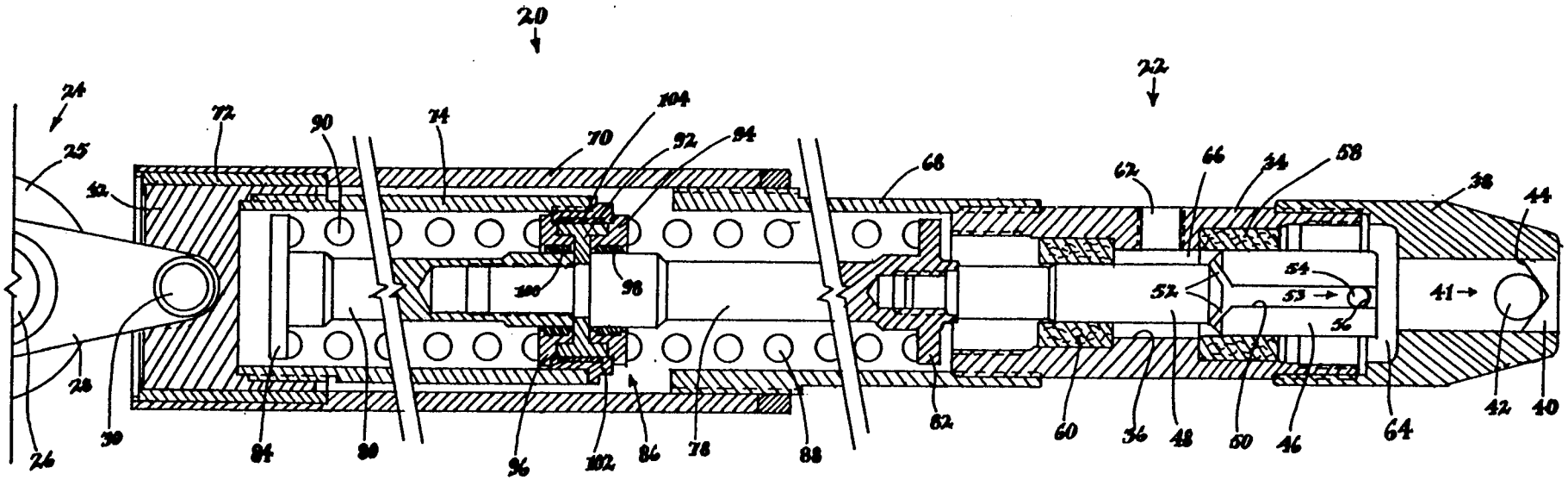
FIG. 1 is a cross sectional view of a pressure responsive driver, constructed according to one embodiment of the invention, coupled between a reciprocating motor means output and a piston of a double-acting pump.

FIG. 1 shows one embodiment of a pressure responsive driver 20 for coupling a double-acting pump 22 to an output from a motor means 24 for operation of the pump by the motor means through the driver. The motor means may comprise any suitable means, such as an electric motor or gasoline engine, for rotating a crank 25 having a crank pin 26. A connecting rod 28 is rotatably mounted at one end on the crank pin, the other end of which defines a reciprocating output from the motor means and is rotatably mounted on a wrist pin 30 carried by a slider 32 of the pressure responsive driver. As will be described, operation of the motor means reciprocates the slider via the connecting rod, and reciprocating movement of the slider is coupled to a piston of the pump in a manner to limit pump outlet pressure to a selected maximum value and to move the piston only to the extent necessary to accommodate a demand for fluid from the pump. In essence, the reciprocating output from the motor means is divided between the driver 20 and pump piston, such that the driver takes up or "absorbs" any reciprocating movement of the connecting rod that is not required to move the piston. In this manner, the motor means is allowed to operate continuously without causing pump outlet pressure to exceed the selected maximum value.

The pump 22 comprises a pump housing 34 having a pump cylinder 36 and a foot valve body 38 threaded onto a forward end of the housing and defining a pump inlet opening 40. A foot valve 41 is within the body adjacent the inlet opening, and includes a ball 42 engagable with a rearwardly facing seat 44. As is conventional, means are provided (not shown) for limiting rearward movement of the ball so that it remains operatively positioned with respect to the seat.

Reciprocable within the pump cylinder 36 is a piston 46 and a coaxial piston rod 48 of smaller diameter than the piston. The rod extends rearwardly (leftwardly in the drawing) from the piston and is threadably connected at its rearward end to the pressure responsive driver 20 for being reciprocated by the driver. The piston has a passage 50 centrally therethrough, and a plurality of ports 52 are between the passage and a rearward surface of the piston. A ball valve 53 having a ball 54 and a rearwardly facing seat 56 is within the piston passage, and forward packing rings 58 seal with the piston. Rearward packing rings 60 seal with the piston rod, and an outlet 62 from the pump extends through the pump housing 34 intermediate the packing rings.

The structure of the pump defines two pumping chambers at opposite ends of the piston 46, a first chamber 64 between the foot valve 41 and packing rings 58 and a second chamber 66 in the annular space surrounding the piston rod 48 between the rearward end of the piston and the packing rings 60. The cylinder 36, piston and piston rod are sized so that the forward chamber 64 has a volumetric pumping capacity substantially twice as great as that of the rearward chamber 66.

In operation, as the piston 46 is moved rearwardly, a subatmospheric pressure condition is created in the chamber 64, causing the piston ball valve 53 to close and the foot valve 41 to open, so that a charge of paint or other material is drawn through the inlet 40 into the pumping chamber 64. On a forward or rightward stroke of the piston, the foot valve 41 closes and the pressure imposed upon the material in the pumping chamber 64 forces the piston ball valve 53 open, whereupon the material in the chamber 64 is progressively displaced into the chamber 66 through the ball valve, passage 50 and ports 52 in the piston. However, since the chamber 66 has only one-half the pumping capacity of the chamber 64, only one-half of the material in the chamber 64 can be stored in the chamber 66 and the remainder is discharged through the pump outlet 62. On the next leftward stroke of the piston, the chamber 64 is again filled and at the same time the volume of the chamber 66 is progressively decreased by movement of the piston into the same, whereupon the material that has been stored in the chamber 66 is progressively discharged through the pump outlet. Thus, on each full stroke of the pump, a predetermined volume of material, equal approximately to one-half the pumping volume of the forward chamber 64, is discharged through the pump outlet. For less than full strokes of the piston, proportionately less material is discharged, and the pressure of fluid at the pump outlet is directly related to the magnitude of reciprocation forces exerted on the piston.

The pressure responsive driver 20 couples the motor means 24 to the pump 22 to operate the pump, and in particular couples the reciprocating motion of and reciprocation forces exerted by the connecting rod 28 to the piston rod 48 to reciprocate the piston rod and piston 46 to the extent necessary to deliver fluid from the pump and to limit pump outlet pressure to a selected maximum value. To that end, the pressure responsive driver includes a fluid section mounting tube 68 threadably attached at its forward end to a rearward end of the pump housing 34 and at its rearward end to a forward end of a slider mounting tube 70. The slider 32 is reciprocated by the connecting rod within a cylindrical bearing 72 in a rearward end of the tube 70, and a drive tube 74 is threadably attached at its rearward end to a forward end of the slider for conjoint reciprocation with the slider in the tube 70. Forward and rearward drive rods 78 and 80 extend coaxially through the tubes 68 and 74, a rearward end of the rod 78 is threaded into a forward end of the rod 80, and a rearward end of the piston rod 48 is threaded into a forward end of the rod 78, so that the rods 78 and 80, piston rod and piston are connected for conjoint reciprocation. An annular flange 82 is at the forward end of the rod 78 and an annular flange 84 is at the rearward end of the rod 80, and extending around the rods between the flanges and an annular drive mechanism 86 are coil springs 88 and 90.

The drive mechanism 86 includes an annular spring stop 92 of T-shaped cross section, captured around its inner periphery between the rods 78 and 80, and a pair of annular spring seats 94 and 96, of L-shaped cross section, around the rods on opposite sides of the spring stop. Facing ends of the springs 88 and 90 engage respective spring seats 94 and 96, and the spring seats are reciprocable along their respective rods on associated bearings 98 and 100. An annular drive collar 102 is threaded into the forward end of the drive tube 74, and at its opposite longitudinal ends engages radial shoulders of the spring seats. The drive collar is reciprocable along the outer periphery of the spring stop on a cylindrical bearing 104.

The springs 88 and 90 are of a length so that when the drive rods 78 and 80, springs and drive mechanism 86 are assembled, the springs are preloaded or precompressed a selected amount between the annular flanges 82 and 84 and spring seats 94 and 96. The particular preload value or precompression force of the springs determines the approximate maximum fluid pressure that may be developed at the pump outlet 62, and may be controlled by appropriate selection of spring type, spring length and/or length of the rods 78 and 80, such that a selected preload condition or precompression force exerted by the springs is achieved when the rods are attached together.

In operation, the pressure responsive driver 20 couples the reciprocating motion of and reciprocation forces exerted by the connecting rod 28 to the pump piston rod 48 and piston 46 to reciprocate the same only to the extent necessary to deliver fluid from and develop a selected maximum pressure of fluid at the pump outlet 62. The components are shown with the pump piston at the bottom or forwardmost end of its stroke, and in a contemplated embodiment the connecting rod reciprocates the slider 32 through a ½" stroke. The drive tube 74 and drive collar 102 are reciprocated conjointly with the slider, and upon rearward reciprocation, the drive collar moves the spring seat 96 rearwardly. If at that time the fluid pressure at the pump outlet is sufficiently low that the force required to reciprocate the piston is less than the spring precompression force, upon rearward movement of the spring seat 96 the spring 90 does not compress, but instead acts as a solid member to move the annular flange 84, and therefore the pump piston, rearwardly to effect a pumping stroke. However, if at the beginning of or during the pumping stroke the fluid pressure at the pump outlet reaches a pressure such that the force required to reciprocate the piston exceeds spring precompressing force, upon continued rearward movement of the drive collar, the spring seat 96 will slide rearwardly along its bearing 100 and compress the spring 90 beyond its preload condition. As the spring is compressed it exerts an increasing rearward force on the annular flange 84 and pump piston, thereby causing a slight further increase in pump outlet pressure. However, maximum pump pressure that can be developed is determined by the maximum extent of compression of the spring, and for the contemplated embodiment the maximum possible extent of compression would be ½" if, at the very beginning of a rearward stroke, pump outlet pressure were already at its maximum value.

In a forward stroke, the drive collar 102 moves the spring seat 94 forwardly. If at that time the pressure at the pump outlet 62 is sufficiently low that the force required to reciprocate the piston 46 is less than spring precompression force, the spring 88 acts as a solid member to move the flange 82 and piston forwardly to effect a pumping stroke. However, if at the beginning of or during the forward pumping stroke the pressure developed at the pump outlet becomes sufficiently great that the force required to reciprocate the piston exceeds the precompression force, upon continued forward movement of the drive collar the spring seat 94 will slide forwardly along its bearing 98 and compress the spring 88 beyond its preload condition. As the spring is compressed it exerts an increasing force on the piston, thereby causing a slight further increase in pump outlet pressure. However, maximum pump pressure that can be developed is determined by the maximum extent of compression of the spring, and for the contemplated embodiment the maximum possible extent of compression is ½". Naturally, the maximum extent of spring compression can be more or less than ½", depending upon the stroke of the connecting rod.

The pump outlet pressure at which the reciprocation force exerted on the pump piston 46 equals spring precompression force may be reached at any point during a forward or rearward pumping stroke. When the occurs, whichever spring 88 or 90 is then transmitting reciprocation forces to the piston will compress and take up some or all of the reciprocating motion of and reciprocation forces exerted by the motor means connecting rod 28, so that the same are not then transmitted or coupled to the pump piston. The reciprocating output from the motor means is therefore divided between the springs and pump piston, such that the amount of flexure of the springs is inversely proportional to movement of the piston, and any reciprocating motion of and reciprocation forces exerted by the motor means that are not transmitted to the piston are taken up by the springs. For better control over pump outlet pressures, when one spring compresses it is desirable that the other not expand and follow it, and for the purpose the spring stop 92 is fixed at the juncture between the drive rods 78 and 80.

Figure 2:
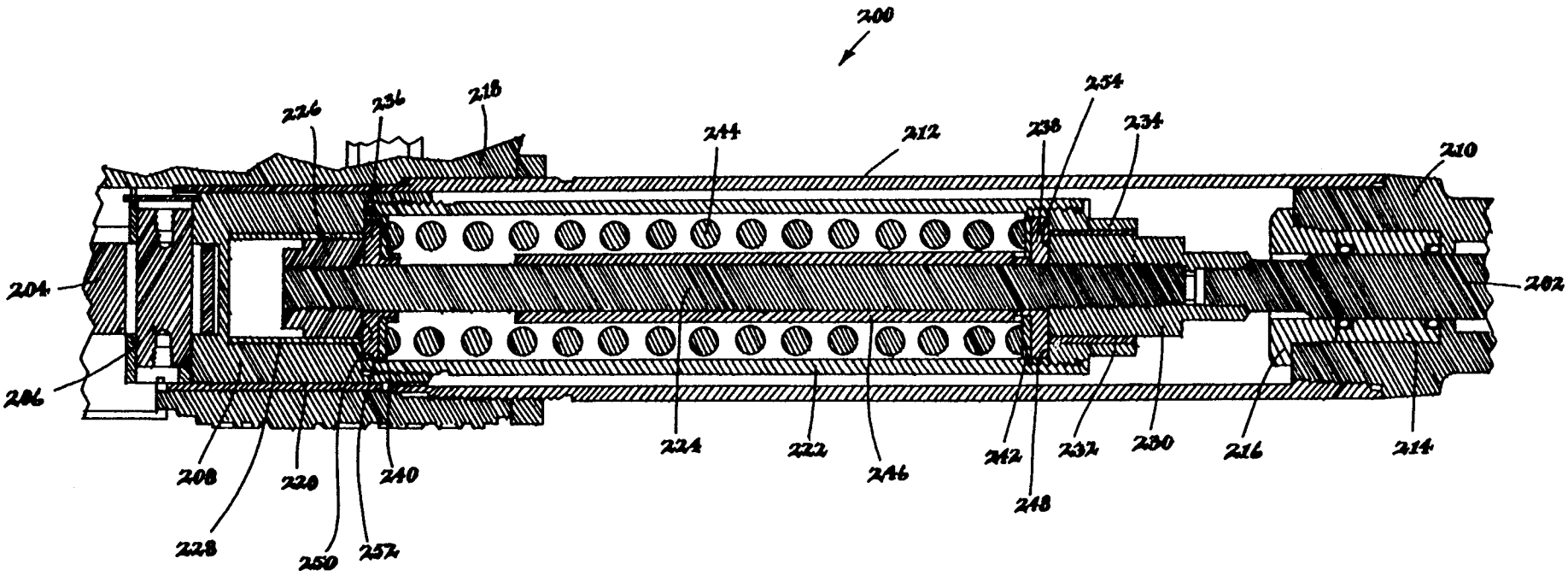
FIG. 2 is a cross sectional view of a pressure responsive driver, constructed according to another embodiment of the invention, coupled between a reciprocating motor means output and a piston of a pump.

FIG. 2 shows another embodiment of a pressure responsive driver, indicated generally at 200, for coupling a piston rod 202 of a double-acting pump to an output from a motor means. The motor means may comprise any suitable means, such as an electric motor or gasoline engine, for rotating a crank having a crank pin. A connecting rod 204 is rotatably mounted at one end on the crank pin, the other end of which defines a reciprocating output from the motor means and is rotatably mounted on a wrist pin 206 carried by a slider 208 of the driver. As for the embodiment of FIG. 1, and as will be described, operation of the motor means reciprocates the slider via the connecting rod, and reciprocating movement of the slider is coupled to the piston rod 202 in a manner to limit pump outlet pressure to a selected maximum value and to move the pump piston only to the extent necessary to accomodate a demand for fluid from the pump. In essence, the reciprocating output from the motor means is divided between the driver 200 and pump piston, such that the driver takes up or "absorbs" any reciprocating movement of the connecting rod that is not required to move the piston. In this manner, the motor means is allowed to operate continuously without causing pump outlet pressure to exceed the selected maximum value.

Although shown fragmentarily, it is understood that the pump is similar to the pump 22 in FIG. 1, and includes a pump housing 210, the rearward end of which is threadably attached to the forward end of an outer tube 212 of the pressure responsive driver 200. The rearward end of the piston rod 202 slidably extends through a sealing member 214 that is received within the rearward end of the pump housing and held therein by a retaining nut 216.

The pressure responsive driver 200 couples the motor means to the pump to operate the pump, and in particular couples the reciprocating motion of and reciprocation forces exerted by the connecting rod 204 to the piston rod 202 to reciprocate the piston rod and pump piston to the extent necessary to deliver fluid from the pump and to limit pump outlet pressure to a selected maximum value. To that end, the pressure responsive driver includes the outer tube 212, which is threadably attached at its forward (rightward) end to the rearward end of the pump housing 210 and at its rearward (leftward) end to a housing 218 of the motor means. The slider 208 is reciprocated by the connecting rod within a cylindrical bearing 220 carried in the motor means housing, and a spring tube 222 is threadably attached at its rearward end to a forward end of the slider for conjoint reciprocation with the slider within the outer tube 212.

A drive rod 224 extends coaxially through the outer tube 212 and spring tube 222. A rearward end of the drive rod is threaded into an inner slider 226 that is reciprocable within a cylindrical bearing 228 carried within the slider 208. A forward end of the drive rod is threaded into a rearward end of a coupling 230, and a rearward end of the pump piston rod 202 is threaded into a forward end of the coupling. A cylindrical bearing 232 is carried on the outer periphery of the coupling, and slidably carried on the bearing is a cylindrical retainer 234 that is threaded into a forward end of the spring tube 222. The coupling connects the drive rod and pump piston rod for conjoint reciprocation.

An annular collar 236 is around and slidable along the rearward end of the drive rod 224 and an annular collar 238 is around and slidable along the forward end of the drive rod. The annular collars are of L-shaped cross section, and carry respective spring seats 240 and 242 that also are of L-shaped cross section. A single coil spring 244 extends around the drive rod and between the spring seats, and a tube 246 extends around and along a portion of the length of the drive rod and is slidable along the drive rod to protect the drive rod against abrasion as a result of any radial deformation of the spring. The spring 244 is of a length such that, when the pressure responsive driver 200 is assembled, the spring is preloaded or precompressed a selected amount between the spring seats 240 and 242. The particular preload value or precompression force of the spring determines the approximate maximum fluid pressure that may be developed at the pump outlet, and may be controlled by appropriate selection of spring type, spring length and/or the spacing between the spring seats, such that a selected preload condition or precompression force exerted by the spring is achieved when the driver is assembled.

In operation, the pressure responsive driver 200 couples the reciprocating motion of and reciprocation forces exerted by the connecting rod 204 to the pump piston rod 202 to reciprocate the pump piston only to the extent necessary to deliver fluid from and develop a selected maximum pressure at the pump outlet. Assuming that the pump piston is at the bottom or forwardmost (rightmost) end of its stroke, the slider 208, spring tube 222 and retainer 234 reciprocate conjointly, and upon rearward (leftward) reciprocation of the same an annular shoulder 248 on the retainer engages and moves the annular collar 238 and its spring seat 242 rearwardly. If at that time the fluid pressure at the pump outlet is sufficiently low that the force required to reciprocate the piston is less than spring precompression force, upon rearward movement of the spring seat 242 the spring 244 does not compress, but instead acts as a solid member to move the spring seat 240, annular collar 236, inner slider 226, drive rod 224 and piston rod 202 rearwardly to effect a pumping stroke, by virtue of the collar 236 engaging an annular shoulder 250 on the inner slider. However, if at the beginning of or during the pumping stroke fluid at the pump outlet reaches a pressure such that the force required to reciprocate the piston exceeds spring precompression force, then the piston rod and drive rod will not move rearwardly, but instead the retainer 234 will slide rearwardly along its bearing 232 and move the collar 238 rearwardly along the drive rod to compress the spring beyond its preload condition. As the spring is compressed it will exert an increasing rearward force on the inner slider 226 and therefore on the pump piston, thereby causing a slight further increase in pump outlet pressure. However, maximum pump pressure that can be developed is determined by the maximum extent of compression of the spring, and for the contemplated embodiment the maximum possible extent of compression is ½" if, at the very beginning of a rearward stroke, pump outlet pressure is already at its maximum value.

In a forward (rightward) stroke, an annular shoulder 252 on the slider 208 engages the collar 236 and pushes it and its spring seat 240 forwardly. If at that time the pressure at the pump outlet is sufficiently low that the force required to reciprocate the pump piston is less than spring precompression force, the spring 244 acts as a solid member and moves the spring seat 242, collar 238, coupling 230 and pump piston forwardly to effect a pumping stroke, by virtue of the collar 238 engaging and acting against an annular shoulder 254 on the coupling. However, if at the beginning of or during the forward pumping stroke the pressure developed at the pump outlet becomes sufficiently great that the force required to reciprocate the piston exceeds spring precompression force, then the coupling and drive rod 224 will not move forwardly, but instead the collar 236 will slide forwardly along the drive rod and compress the spring beyond its preload condition as the retainer 234 slides forwardly along its bearing 232. As the spring is compressed it will exert an increasing force on the piston, thereby causing a slight further increase in pump outlet pressure. However, maximum pump pressure that can be developed is determined by the maximum possible extent of compression of the spring, which is ½". Naturally, the maximum extent of spring compression can be more or less than ½" depending upon the stroke of the connecting rod 204.

The pump outlet pressure at which the reciprocation force exerted on the pump piston equals spring precompression force may be reached at any point during a forward or rearward pumping stroke. When that occurs, the spring 244 will compress and take up some or all of the reciprocating motion of and reciprocation forces exerted by the motor means connecting rod 204, so that the same are not then transmitted or coupled to the pump piston. The reciprocating output from the motor means is therefor divided between the spring and pump piston, such that the amount of flexure of the spring is inversely proportional to movement of the piston, and any reciprocating motion of and reciprocation forces exerted by the motor means that are not transmitted to the piston are taken up by the spring.

The invention thus provides novel pressure responsive drivers 20 and 200 for piston pumps, which couple a reciprocating output from a motor means to a piston of a pump in a manner to move the piston only to the extent necessary to meet demands for delivery of fluid and to bring pump outlet pressure to and limit it at a selected maximum value, while allowing the motor means to operate continuously. For long life and strength, the springs 88 and 90 and spring 244 advantageously are die springs, and the extent of their preloading or precompression determines the lower limit of a maximum range of pressures allowed to be developed at the pump outlet. The upper limit is then determined by spring characteristics and the maximum extent to which they may be compressed, i.e., by the stroke of the connecting rod or pump. To minimize pump outlet pressure fluctuations, it is desirable that the range of pressures be limited, and the longer the lengths of the springs, the flatter are their force curves during compression and the narrower is the range of pressures. The springs should therefore be as long as is permitted by any constraints on the overall size of the driver.

Although the pressure responsive drivers 20 and 200 have been described as coupling the output from a motor means to a double-acting pump, they could also be used with a single-acting pump. In the case of the driver 20, both springs 88 and 90 would not be required. Instead, only the one for moving the pump piston in the direction of its pumping stroke would be necessary.

While embodiments of the invention have been described in detail, various modifications and other embodiments thereof may be devised by one skilled in the art without departing from the spirit and scope of the invention, as defined in the appended claims.

What is claimed is:

1. A pressure responsive driver for coupling a reciprocating output from a motor means to a reciprocable piston of a pump having a fluid inlet and a fluid outlet, wherein the pressure of fluid at the pump outlet is in accordance with the magnitude of reciprocation forces exerted on the piston, said pressure responsive driver comprising reciprocable input means adapted for connection to the motor means output for being reciprocated thereby; reciprocable output means adapted for connection to the pump piston to reciprocate the piston; and means for coupling said input means to said output means, said coupling means including a single spring for transferring reciprocation forces exerted on said input means by the motor means output from said input means to said output means in both directions of reciprocation and being responsive to the magnitude of transferred reciprocation forces to limit transferred reciprocation forces to a predetermined magnitude while said input means is reciprocated by the motor means output, whereby reciprocation forces exerted on the pump piston are limited to said predetermined magnitude to limit the pressure of fluid at the pump outlet to a selected maximum pressure.

2. A pressure responsive driver as in claim 1, wherein said coupling means spring resiliently couples said input means to said output means when the transferred reciprocation forces exceed said predetermined magnitude.

3. A pressure responsive driver as in claim 1, wherein said coupling means spring compresses in response to and absorbs reciprocating forces, in excess of said predetermined magnitude, exerted on said input means by the motor means output, so that the same are not transferred to said output means.

4. A pressure responsive driver as in claim 1, wherein said coupling means spring extends between said input means and output means, said input means exerts reciprocation forces on said spring tending to compress said spring in the directions of reciprocation and said spring transfers said forces to said output means in each direction of reciprocation, said coupling means including means for maintaining said spring precompressed with a force of substantially said predetermined magnitude, whereby said spring transfers from said input means to said output means reciprocation forces having a magnitude less than or equal to said predetermined magnitude and compresses in response to and absorbs reciprocation forces in excess of said predetermined magnitude to limit reciprocation forces transferred to said output means to said predetermined magnitude.

5. A pressure responsive driver for coupling a reciprocating output from a motor means to a reciprocable piston of a pump having a fluid inlet and a fluid outlet, wherein the pressure of fluid at the pump outlet is in accordance with the magnitude of reciprocation forces exerted on the piston, said pressure responsive driver comprising reciprocable input means adapted for connection to the motor means output for reciprocation thereby; reciprocable output means adapted for connection to the pump piston to reciprocate the piston; and coupling means extending between said input means and said output means, said coupling means including a single spring for transferring reciprocation forces exerted on said input means by the motor means output, and having a magnitude no greater than a predetermined magnitude, from said input means to said output means in both directions of reciprocation, and for absorbing reciprocation forces exerted on said input means that have a magnitude greater than said predetermined magnitude, so that the same are not transferred to said output means, whereby reciprocating forces exerted on the pump piston by said output means are limited to said predetermined magnitude and pump outlet pressure is limited to a selected maximum pressure.

6. A pressure responsive driver as in claim 5, wherein said coupling means spring extends between said input means and output means, said input means exerts reciprocation forces on said spring tending to compress said spring in the directions of reciprocation and said spring transfers said forces to said output means in each direction of reciprocation, said coupling means including means for maintaining said spring precompressed with a force of substantially said predetermined magnitude, whereby said spring transfers from said input means to said output means reciprocation forces having a magnitude less than or equal to said predetermined magnitude and compresses in response to and absorbs reciprocating forces in excess of said predetermined magnitude to limit reciprocation forces transferred to said output means to said predetermined magnitude.

7. A fluid pumping system, comprising motor means having a reciprocating output; pump means having a fluid inlet, a fluid outlet and a reciprocable pumping piston, the pressure of fluid at said outlet being in accordance with the magnitude of reciprocation forces exerted on said piston; and a pressure responsive driver coupled between said motor means output and said pump piston, said pressure responsive driver including reciprocable input means connected to said motor means output for reciprocation thereby, reciprocable output means connected to said pump piston to reciprocate said piston, and means for coupling said input means to said output means, said coupling means including a single spring for transferring reciprocation forces exerted on said input means by said motor means output to said output means in both directions of reciprocation and being responsive to the magnitude of transferred reciprocation forces to limit transferred reciprocation forces to a predetermined magnitude while said input means is reciprocated by said motor means output, whereby reciprocation forces exerted by said output means on said pump piston are limited to said predetermined magnitude and the pressure of fluid at said pump means outlet is limited to a selected maximum pressure.

8. A fluid pumping system as in claim 7, wherein said coupling means spring compresses and absorbs reciprocation forces, in excess of said predetermined magnitude, exerted on said input means by said motor means output, so that the same are not transferred to said output means and pump piston.

9. A fluid pumping system as in claim 7, wherein said coupling means spring extends between said input means and output means, said input means exerts reciprocation forces on said spring tending to compress said spring in the directions of reciprocation and said spring transfers said forces to said output means in each direction of reciprocation, said coupling means including means for maintaining said spring precompressed with a force of substantially said predetermined magnitude, whereby said spring transfers from said input means to said output means reciprocation forces having a magnitude less than or equal to said predetermined magnitude and compresses in response to and absorbs reciprocation forces in excess of said predetermined magnitude to limit reciprocation forces transferred to said output means and pump piston to said predetermined magnitude.

10. A fluid pumping system as in claim 9, wherein said pump means comprises a double-acting pump.

11. A method of connecting a reciprocating output from a motor to a reciprocable piston of a pump having a fluid inlet and a fluid outlet, wherein the pressure of fluid at the pump outlet is in accordance with the magnitude of reciprocation forces exerted on the piston, said method comprising the steps of continuously mechanically coupling, through a single spring, the reciprocating output from the motor to the pump piston to transfer reciprocation forces, through the spring and in both directions of reciprocation, from the motor output to the piston; and controlling said continuously mechanically coupling step to limit reciprocation forces transferred to the pump piston to a predetermined magnitude while the motor output continues to reciprocate, so that fluid pressure at the pump outlet is limited to a selected maximum pressure.

12. A method as in claim 11, wherein said controlling step comprises maintaining the spring precompressed with a force of substantially the predetermined magnitude, so that the spring transfers from the motor to the pump piston reciprocation forces having a magnitude less than or equal to the predetermined magnitude and compresses in response to and absorbs reciprocation forces in excess of the predetermined magnitude to limit reciprocation forces transferred to the pump piston to the predetermined magnitude.

13. A method of connecting a reciprocating output from a motor to a reciprocable piston of a pump having a fluid inlet and a fluid outlet, wherein the pressure of fluid at the pump outlet is in accordance with reciprocation forces exerted on the piston, said method comprising the steps of continuously mechanically coupling, through a single spring, the reciprocating output from the motor to the pump piston to transfer reciprocation forces, through the spring in both directions of reciprocation, from the motor output to the piston; and controlling said continuously mechanically coupling step so that the spring absorbs reciprocation forces from the motor output that exceed a predetermined magnitude, so that reciprocation forces transferred to the pump piston are limited to the predetermined magnitude and fluid pressure at the pump outlet is limited to a selected maximum pressure.

14. A method as in claim 13, wherein said controlling step comprises maintaining the spring precompressed with a force of substantially the predetermined magnitude, so that the spring transfers from the motor to the pump piston reciprocation forces having a magnitude less than or equal to the predetermined magnitude and compresses in response to and absorbs reciprocation forces in excess of the predetermined magnitude to limit reciprocation forces transferred to the pump piston to the predetermined magnitude.

* * * * *